United States Patent [19]

Hallqvist

[11] Patent Number: 4,483,235

[45] Date of Patent: Nov. 20, 1984

[54] BEARING MEANS FOR A GUN BARREL

[75] Inventor: Sten Hallqvist, Karlskoga, Sweden

[73] Assignee: Aktiebolaget Bofors, Bofors, Sweden

[21] Appl. No.: 380,330

[22] Filed: May 20, 1982

[30] Foreign Application Priority Data

May 26, 1981 [SE] Sweden ..... 8103297

[51] Int. Cl.[3] ..... F41F 17/00

[52] U.S. Cl. ..... 89/14 R; 89/162

[58] Field of Search ..... 42/75 B; 89/4 R, 14 R, 89/37 GM, 160, 161, 162, 163, 164, 165, 166, 167, 168, 169, 177, 178

[56] References Cited

U.S. PATENT DOCUMENTS

| | | | |
|---|---|---|---|
| 2,303,327 | 12/1942 | Coupland | 89/37 GM |
| 2,749,642 | 6/1956 | Saetter-Lassen | 42/75 B |
| 2,750,847 | 6/1956 | Lucht | 89/43 |
| 3,564,967 | 2/1971 | LaViolette et al. | 89/163 |

FOREIGN PATENT DOCUMENTS

| | | |
|---|---|---|
| 3013988 | 10/1981 | Fed. Rep. of Germany . |
| 226706 | 6/1969 | Sweden . |

*Primary Examiner*—Stephen C. Bentley

*Attorney, Agent, or Firm*—Pollock, Vande Sande & Priddy

[57] ABSTRACT

The invention relates to bearing means for a gun barrel (3) mounted in the breech casing of a weapon in which the breech casing comprises a sleeve member (2) enclosing a rear part of the gun barrel (3). The bearing means comprises a cylindrical sleeve (10) positioned between said breech casing sleeve member (2) and the adjoining external gun barrel surface. The sleeve (10) is provided with a spring part which consists of a plurality of finger springs (17) distributed about the peripheral surface of the gun barrel and engaging by the force of spring an enlarged cylindrical part (7) of the external gun barrel surface. This enlarged, cylindrical part (7) has such a length (d) in the longitudinal direction of the gun barrel that the finger springs (17) are engaged to said part (7) during the first phase of the recoil during which the shell, projectile or the like has not yet left the bore of the barrel (3). By means of this invention any play in the bearing means can be compensated so that the spread of shots is reduced.

4 Claims, 2 Drawing Figures

BEARING MEANS FOR A GUN BARREL

TECHNICAL FIELD

The present invention relates to bearing means for a gun barrel mounted in the breech casing of a weapon, the breech casing comprising a sleeve member enclosing the rear part of the gun barrel. The bearing means comprises a cylindrical sleeve positioned between the breech casing sleeve member and the adjacent external surface of the gun barrel.

BACKGROUND ART

For weapons of this type the breech casing is rigidly affixed to the gun mount but the barrel, the screw mechanism and so forth are among the recoiling parts which take part in the recoil movements of the weapon. In order to permit recoil movements, the barrel must be displaceably mounted in the breech casing.

The gun barrel must be mounted in the breech casing so that sufficient play is provided in the bearing means to permit dimensional changes caused by the heating of the gun barrel during firing. Such play is not desired for other reasons, however, mainly because it gives rise to an unwanted spread of the shots. Such spread of shots, caused by the gun itself upon firing, has previously been accepted mainly due to the fact that the contribution from the fire control equipment has dominated the spread of the shots. Efforts have therefore mainly been concentrated on the problem how to reduce this contribution from the fire control equipment.

Now that it is possible to determine the position of a target more precisely and that more sophisticated computers are used in the fire control equipment, these conditions are changing, however. Previously the contribution to the distribution of shots caused by the fire control equipment was about 3–5 mrad but today it has been reduced to 1–2 mrad; that is, the same magnitude as the gun firing spread. This means that efforts now also are concentrated on the problem of how to reduce also the gun firing spread.

The gun firing spread is mainly caused by the oscillating movements of the gun barrel and the elevating system which movements are generated through firing. The oscillating movements have several causes and may for instance, depend upon the forces in recoil brakes, recoil forces on the upper carriage and forces generated by the screw mechanism when closing, opening and loading the chamber of the barrel. A study of such oscillating movements has disclosed that the play between the barrel and the breech casing gives a significant contribution to the gun firing spread.

Recently measures have been taken to limit also the gun firing spread. And specific means have been introduced into the weapon system for damping the oscillating movements. Such damping means, however, makes the gun constructions heavier and more expensive and has not specifically reduced the gun firing spread caused by the play between the barrel and the breech casing.

DISCLOSURE OF THE INVENTION

It is now an object of the present invention to provide bearing means between the barrel and the breech casing in which the play can be mainly eliminated. According to the invention the bearing means is provided with a spring part engaging the external surface of the gun barrel by the force of spring.

In a preferred embodiment of the invention this spring part comprises a plurality of finger springs distributed about the peripheral surface of the gun barrel.

The bearing means is preferably arranged in such a way that the finger springs slidably engage the external surface of the gun barrel only until the shell, projectile or the like has left the bore of the barrel.

BRIEF DESCRIPTION OF THE DRAWING

In the following the invention will be described in more detail with reference to the accompanying drawing which illustrates a preferred embodiment of the invention.

BEST MODE FOR CARRYING OUT THE INVENTION

Figure 1:
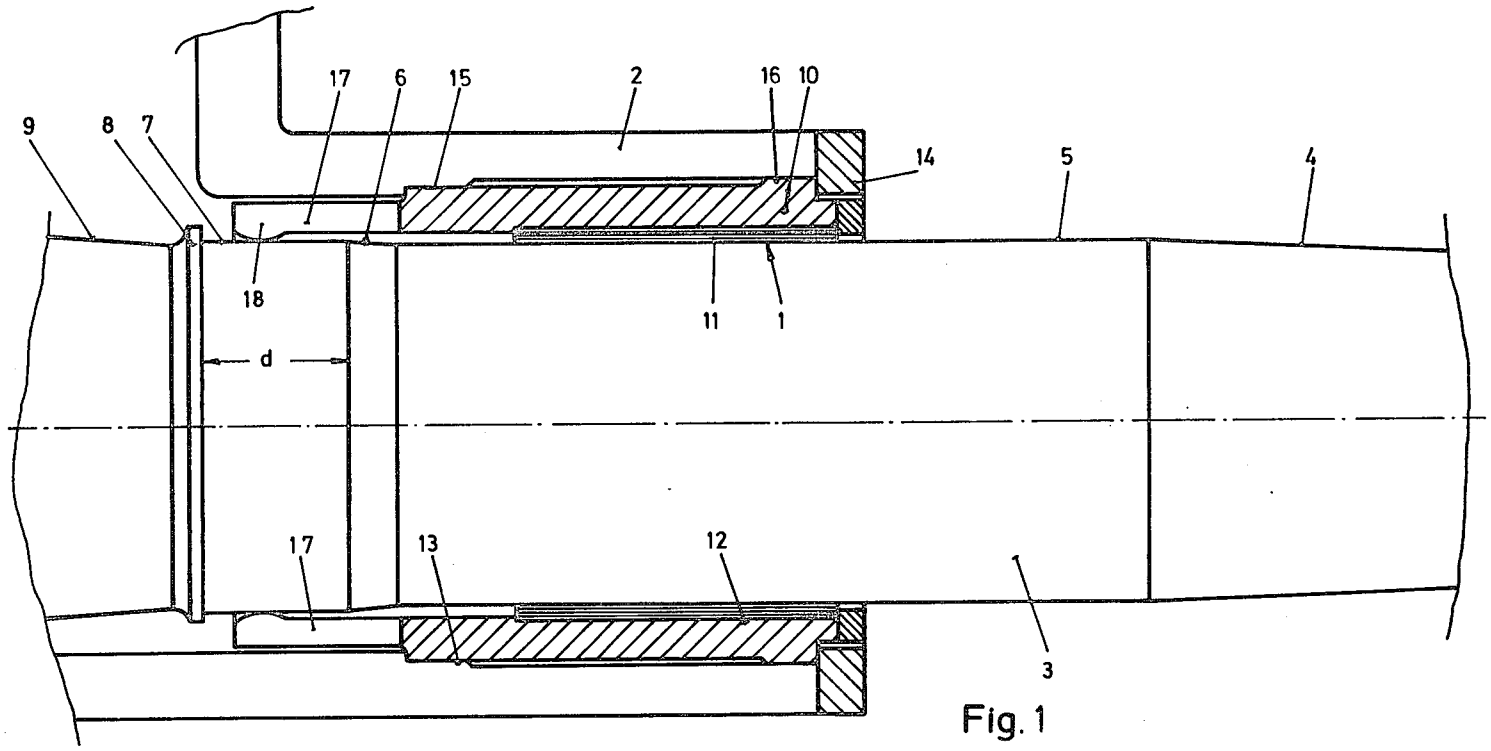
FIG. 1 shows a longitudinal cross-sectional view of the gun barrel bearing means and adjacent parts of the gun barrel construction.

The longitudinal cross-sectional view of FIG. 1 illustrates the bearing means 1 positioned between the breech casing 2 and the gun barrel 3 of a large-caliber weapon, for instance a tank gun, a permanently emplaced coast artillery gun, a field artillery gun or other automatic gun. The breech casing 2 comprises a substantially cylindrical sleeve member enclosing a rear part of the gun barrel. During recoil the barrel is moved relative to the breech casing 2 which is rigidly affixed to the gun mount.

In FIG. 1 only those parts of the barrel 3 which cooperate with the bearing means 1 and adjacent parts are illustrated. As illustrated the external surface of the barrel comprises a number of different conical and cylindrical parts. From the right in the drawing, that is, from the muzzle part of the barrel, a slightly conical, tapered part 4, a forward cylindrical part 5 forming a guiding surface for the bearing means, a small conical part 6, another rearward, cylindrical part 7 with a diameter which exceeds the diameter of said cylindrical part 5, a flange 8 and a rear, slightly conical part 9 enclose the chamber of the barrel.

It is mainly the two cylindrical parts 5 and 7 and the small conical part 6 therebetween which are of interest here since these parts cooperate with the bearing means during the recoil movements as will be described hereinafter.

The bearing means 1 comprises two main parts, an outer cylindrical sleeve 10 adjoining the breech casing 2 and an inner cylindrical guiding sleeve bushing 11 adjoining the external surface of the barrel. The inner cylindrical sleeve 11 is preferably made of a comparatively soft metal, for instance brass, to minimize wear of the external barrel surface. The sleeve 11 is positioned in a small recess or chamber 12 in the outer cylindrical sleeve 10 so that it can quite easily be replaced at wear. The outer cylindrical sleeve 10 on the other side is positioned in a recess or chamber 13 in the breech casing. The bearing means 1 further comprises a retaining and sealing ring 14 to keep the bearing means 1 in its correct position in the breech casing.

In order to permit dimensional changes caused by heating of the barrel during firing there must be sufficient play between the breech casing 2 and the barrel 3. To some extent the undesired effect of such dimensional changes can be reduced by designing the bearing means in an appropriate manner. For instance, the contact surface between the cylindrical sleeve 10 and the breech casing can be limited; and two limited, annular contact surfaces 15 and 16 are illustrated in FIG. 1. There must always be some play, however, between the inner cylindrical sleeve 11 and the external, peripheral surface of the barrel, a play which depends on the barrel diameter and the maximum temperature rise of the barrel and the bearing. This play increases when the inner bushing 11 is worn due to frequent use. As already mentioned the play gives rise to an unwanted spread of the shots.

The outer cylindrical sleeve 10 of the bearing means is therefore provided with a part extending rearwards and which comprises a plurality of finger springs 17 distributed around the external, peripheral barrel surface. The finger springs engage the enlarged cylindrical part 7 of the peripheral barrel surface with a certain spring force. The contact surfaces of the finger springs are slightly rounded so that dimensional changes due to the heating of the barrel can be more easily compensated and to facilitate the sliding of the finger springs along the enlarged, cylindrical part 7 during recoil. The spring forces of the finger springs are determined with respect to the mass of the recoil system and the gravity forces imparted thereto, which makes the bearing means substantially free of play.

In order to reduce wear between the bearing means and the barrel during recoil, the finger springs should not be engaged with the external barrel surface more than necessary. As the play between the barrel and the breech casing only contributes to the undesired spread of shots as long as the shell, projectile or the like is within the barrel it is desired that the finger springs are disengaged as soon as the shell has left the bore of the barrel so that during the remaining part of the recoil movement of the barrel rearwards there is no contact between the finger springs 17 and the external barrel surface. In the present case this has been achieved by means of the specific design of the external barrel surface. The length d of the enlarged cylindrical guide part of the external barrel surface is limited, its length being determined so that the contact surfaces 18 of the finger springs are disengaged from the cylindrical part 7 just at the moment when the shell or projectile is passing the muzzle of the barrel. When the cylindrical part 5 of the external barrel surface moves past the finger springs during recoil, the finger springs no longer engage the barrel surface due to the reduced diameter of this barrel part 5.

During the counterrecoil when the barrel is moved forwards again with respect to the breech casing, the finger springs once again come into contact with the enlarged barrel part 7 and assume a rest position as indicated in FIG. 1. In this position any play is effectively compensated.

Figure 2:
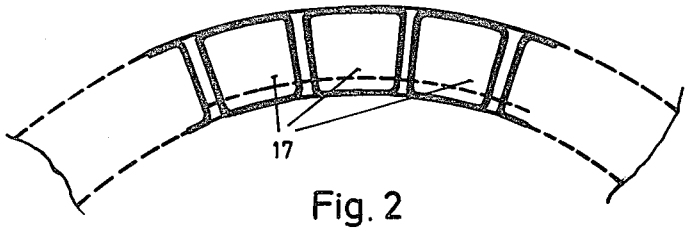
FIG. 2, an enlarged, partial front end view of a number of finger springs.

FIG. 2 shows an enlarged partial view of the front ends of the finger springs 17. In the Figure only the ends of three finger springs 17 are illustrated, but it is assumed that the finger springs are equally distributed about the peripheral surface of the barrel. Of course the number of individual finger springs can be varied depending on the specific application and the desired spring force.

The invention is not limited to the above embodiment, but can be varied within the scope of the following claims.

I claim:

1. An improved large caliber gun comprising:

a breech casing;

a gun barrel having a forward cylindrical part and a larger diameter, rearward cylindrical part;

a cylindrical bearing mounted in said breech casing for slidably engaging said forward cylindrical part during recoil of said gun after firing a projectile; and spring means attached to said bearing for slidably engaging said rearward cylindrical part during recoil only while the projectile remains in the bore of the barrel and for thereafter disengaging from contact with said barrel.

2. A gun according to claim 1, wherein said spring means comprises a plurality of resilient finger springs attached to said cylindrical bearing and extended rearward to engage said rearward cylindrical part only while the projectile remains in the bore of said barrel.

3. A gun according to claim 2, wherein said forward cylindrical part is joined to said rearward cylindrical part by a conical part extended therebetween.

4. A gun according to claim 3, wherein the length of said rearward cylindrical part and said finger springs are such that said finger springs engage said rearward cylindrical part during a first part of said recoil and are separated from said forward and rearward cylindrical parts during a second part of said recoil.

* * * * *